US007354687B2

(12) United States Patent
Stulc et al.

(10) Patent No.: US 7,354,687 B2
(45) **Date of Patent: *Apr. 8, 2008**

(54) DRY TONER BLENDED WITH WAX

(75) Inventors: Leonard Stulc, Shaffer, MN (US); Ronald J. Moudry, Woodbury, MN (US); Zbigniew Tokarski, Woodbury, MN (US); Charles W. Simpson, Lakeland, MN (US); Gay L. Herman, Cottage Grove, MN (US); A. Kristine Fordahl, St. Paul, MN (US); James A. Baker, Hudson, WI (US)

(73) Assignee: Samsung Electronics Company, Suwon (KR)

( * ) Notice: Subject to any disclaimer, the term of this patent is extended or adjusted under 35 U.S.C. 154(b) by 418 days.

This patent is subject to a terminal disclaimer.

(21) Appl. No.: 10/978,688

(22) Filed: Oct. 31, 2004

(65) Prior Publication Data

US 2006/0093938 A1 May 4, 2006

(51) Int. Cl.
*G03G 9/00* (2006.01)

(52) U.S. Cl. ..... 430/108.3; 430/108.8; 430/108.4; 430/109.1; 430/137.15

(58) Field of Classification Search ..... 430/108.3, 430/108.8, 108.4, 109.1, 137.15
See application file for complete search history.

(56) References Cited

U.S. PATENT DOCUMENTS

| | | | |
|---|---|---|---|
| 4,413,048 | A | 11/1983 | Landa |
| 5,061,587 | A | 10/1991 | Tsubuko et al. |
| 5,364,722 | A | 11/1994 | Tanikawa et al. |
| 5,364,724 | A | 11/1994 | Mahabadi et al. |
| 5,554,476 | A | 9/1996 | Landa et al. |
| 5,635,325 | A | 6/1997 | Inaba et al. |
| 5,741,617 | A | 4/1998 | Inaba et al. |
| 5,886,067 | A | 3/1999 | Li et al. |
| 5,935,751 | A | 8/1999 | Matsuoka et al. |
| 5,958,642 | A | 9/1999 | Takagi et al. |
| 5,998,080 | A | 12/1999 | Ohno et al. |
| 6,002,903 | A | 12/1999 | Hayase et al. |
| 6,083,654 | A | 7/2000 | Lin |
| 6,103,781 | A | 8/2000 | Li et al. |
| 6,117,605 | A | 9/2000 | Chiba |
| 6,136,490 | A | 10/2000 | Ogawa et al. |
| 6,153,347 | A | 11/2000 | Kabai et al. |
| 6,203,959 | B1 | 3/2001 | Tanikawa et al. |
| 6,255,363 | B1 | 7/2001 | Baker et al. |
| 6,331,372 | B1 | 12/2001 | Livengood et al. |
| 6,447,970 | B1 | 9/2002 | Matsunaga et al. |
| 6,447,971 | B2 | 9/2002 | Takezawa et al. |
| 6,475,688 | B1 | 11/2002 | Tamura et al. |
| 6,492,083 | B1 | 12/2002 | Livengood et al. |
| 6,506,532 | B2 | 1/2003 | Akai et al. |
| 6,541,174 | B1 | 4/2003 | Tanikawa et al. |
| 6,546,221 | B2 | 4/2003 | Baker et al. |
| 6,649,316 | B2 | 11/2003 | Baker et al. |
| 6,656,653 | B2 | 12/2003 | Mitsuhashi et al. |
| 6,713,221 | B2 | 3/2004 | Kada et al. |
| 2002/0197552 | A1 | 12/2002 | Baker et al. |
| 2004/0091805 | A1 | 5/2004 | Qian et al. |
| 2004/0091806 | A1 | 5/2004 | Qian et al. |
| 2004/0091807 | A1 | 5/2004 | Qian et al. |
| 2004/0091808 | A1 | 5/2004 | Qian et al. |
| 2004/0091809 | A1 | 5/2004 | Qian et al. |
| 2004/0142270 | A1 | 7/2004 | Qian et al. |

FOREIGN PATENT DOCUMENTS

| | | |
|---|---|---|
| EP | 1396762 | 8/2003 |
| EP | 1422572 | 11/2003 |
| EP | 1553459 | 12/2004 |

OTHER PUBLICATIONS

Commonly assigned U.S. Appl. No. 10/881,637, filed Jun. 30, 2004, entitled "Drying Process for Toner Particles Useful in Electrography," in the name of Chou et al.
Commonly assigned U.S. Appl. No. 10/880,799, filed Jun. 30, 2004, entitled "Extrusion Drying Process for Toner Particles Useful in Electrography," in the name of Moudry et al.
Commonly assigned U.S. Appl. No. 10/978,635, filed Oct. 31, 2004, entitled "Liquid Electrophotographic Toners Comprising Amphipathic Copolymers Having Acidic or Basic Functionality and Wax Having Basic or Acidic Functionality", in the name of Moudry et al.
Commonly assigned U.S. Appl. No. 10/978,703, filed Oct. 31, 2004, entitled "Liquid Toners Comprising Amphipathic Copolymeric Binder and Dispersed Wax for Electrographic Applications," in the name of Simpson et al.
Commonly assigned U.S. Appl. No. 10/978,697, filed Oct. 31, 2004, entitled "Dry Toner Comprising Entrained Wax," in the name of Simpson et al.
Commonly assigned U.S. Appl. No. 10/978,836, filed Oct. 31, 2004, entitled "Dry Toner Comprising Wax," in the name of Herman et al.
11 pgs., "The influence of rheology and molecular architecture on the fusing behavior of toners," DeMejo et al, SPIE, vol. 1253 Hard Copy and Printing Materials, Media, and Process (1990), pp. 85-95.
4 pgs., "Rheological Study on Fixing Polyester Resin Toners," Satoh et al, Journal of Imaging Science, vol. 35, No. 6, Nov./Dec. 1991, pp. 373-376.
2 pgs., Clariant Gmbh, Sep. 2003 News Bulletin, "Toner Waxes".

(Continued)

*Primary Examiner*—Mark A. Chapman
(74) *Attorney, Agent, or Firm*—Kagan Binder, PLLC

(57) ABSTRACT

Dry electrographic toner compositions are provided comprising a plurality of dry toner particles, wherein the toner particles comprise polymeric binder comprising at least one amphipathic copolymer comprising one or more S material portions and one or more D material portions. The dry electrographic toner composition comprises a wax associated with the dry toner particles, wherein substantially all of the wax is associated with the toner particle at the surface thereof. Methods of making electrographic toner compositions are also provided comprising preparing polymeric binder particles comprising at least one amphipathic copolymer comprising one or more S material portions and one or more D material portions, preparing toner particles, drying the toner particles, and milling the dry toner particles in the presence of a wax component to provide a dry toner particle composition having the wax associated with the toner particles. These toner compositions provide images having excellent durability and erasure resistance properties at low fusion temperatures and with little undesired offset.

16 Claims, No Drawings

DRY TONER BLENDED WITH WAX

FIELD OF THE INVENTION

The present invention relates to dry toner compositions having utility in electrography. More particularly, the invention relates to dry toner compositions comprising an amphipathic copolymer binder, and additionally comprising a wax.

BACKGROUND OF THE INVENTION

In electrophotographic and electrostatic printing processes (collectively electrographic processes), an electrostatic image is formed on the surface of a photoreceptive element or dielectric element, respectively. The photoreceptive element or dielectric element can be an intermediate transfer drum or belt or the substrate for the final toned image itself, as described by Schmidt, S. P. and Larson, J. R. in Handbook of Imaging Materials Diamond, A. S., Ed: Marcel Dekker: New York; Chapter 6, pp 227-252, and U.S. Pat. Nos. 4,728,983, 4,321,404, and 4,268,598.

Electrophotography forms the technical basis for various well-known imaging processes, including photocopying and some forms of laser printing. Other imaging processes use electrostatic or ionographic printing. Electrostatic printing is printing where a dielectric receptor or substrate is "written" upon imagewise by a charged stylus, leaving a latent electrostatic image on the surface of the dielectric receptor. This dielectric receptor is not photosensitive and is generally not re-useable. Once the image pattern has been "written" onto the dielectric receptor in the form of an electrostatic charge pattern of positive or negative polarity, oppositely charged toner particles are applied to the dielectric receptor in order to develop the latent image. An exemplary electrostatic imaging process is described in U.S. Pat. No. 5,176,974. In contrast, electrophotographic imaging processes typically involve the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively exposing the photoreceptor to electromagnetic radiation, thereby discharging the charged surface of the photoreceptor in an imagewise manner corresponding to the desired image to be formed on the final image receptor. The electromagnetic radiation, which can also be referred to as "light," can include infrared radiation, visible light, and ultraviolet radiation, for example.

In the development step, toner particles of the appropriate polarity are generally brought into contact with the latent image on the photoreceptor, typically using a developer electrically-biased to a potential having the same polarity as the toner polarity. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor.

In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, residual toner remaining on the photoreceptor is removed. Finally, in the erasing step, the photoreceptor charge is reduced to a substantially uniformly low value by exposure to light of a particular wavelength band, thereby removing remnants of the original latent image and preparing the photoreceptor for the next imaging cycle.

Electrophotographic imaging processes can also be distinguished as being either multi-color or monochrome printing processes. Multi-color printing processes are commonly used for printing graphic art or photographic images, while monochrome printing is used primarily for printing text. Some multi-color electrophotographic printing processes use a multi-pass process to apply multiple colors as needed on the photoreceptor to create the composite image that will be transferred to the final image receptor, either by via an intermediate transfer member or directly. One example of such a process is described in U.S. Pat. No. 5,432,591.

A single-pass electrophotographic process for developing multiple color images is also known and can be referred to as a tandem process. A tandem color imaging process is discussed, for example in U.S. Pat. Nos. 5,916,718 and 5,420,676. In a tandem process, the photoreceptor accepts color from developer stations that are spaced from each other in such a way that only a single pass of the photoreceptor results in application of all of the desired colors thereon.

Alternatively, electrophotographic imaging processes can be purely monochromatic. In these systems, there is typically only one pass per page because there is no need to overlay colors on the photoreceptor. Monochromatic processes may, however, include multiple passes where necessary to achieve higher image density or a drier image on the final image receptor, for example.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

In electrographic printing with dry toners the durability (e.g. erasure and blocking resistance) and archivability of the toned image on a final image receptor such as paper is often of critical importance to the end user. The nature of the final image receptor (e.g. composition, thickness, porosity, surface energy and surface roughness), the nature of the fusing process (e.g. non-contact fusing involving a heat source or contact fusing involving pressure, often in combination with a heat source), and the nature of the toner particles (e.g. developed mass per unit area, particle size and shape, composition and glass transition temperature ($T_g$) of the toner particles and molecular weight and melt rheology of the polymeric binders used to make the toner particles), may all affect the durability of the final toned image as well as the energy required to heat the fuser assembly to the proper fusing temperature. The proper fusing temperature is operationally defined as the minimum temperature range above the $T_g$ at which the fused toned image develops sufficient adhesion to the final image receptor to resist removal by abrasion or cracking (see, e.g., L. DeMejo, et al., *SPIE Hard Copy and Printing Materials, Media, and Process*, 1253, 85 (1990); and T. Satoh, et al., *Journal of Imaging Science*, 35 (6), 373 (1991).). Minimizing the proper fusing temperature is desirable because the time required to heat the fuser assembly to the proper temperature will be reduced, the power consumed to maintain the fuser assembly at the proper temperature will be reduced, and the thermal demands on the fuser roll materials will be reduced if the minimum fusing temperature can be reduced. The art continually searches for improved dry toner compositions that produce high quality, durable images at low fusion temperatures on a final image receptor.

SUMMARY OF THE INVENTION

Dry electrographic toner compositions are provided comprising a plurality of dry toner particles. The toner particles comprise polymeric binder comprising at least one amphipathic copolymer comprising one or more S material portions and one or more D material portions. A wax is associated with the dry toner particles, wherein substantially all of the wax is associated with the toner particle at the surface thereof.

For purposes of the present invention, the term "associated with" means that the wax component is in physical contact with the toner particle, but is not covalently bonded to the toner particle. While not being bound by theory, it is believed that the wax component as provided in this toner composition configuration provides an environment of close association by partial or complete encapsulation of the binder particle with the wax, thereby providing physical and/or physical-chemical interaction (without the formation of covalent bonds) that promotes durable association of the wax to the toner particle. In certain preferred embodiments, the wax is an acid-functional or basic-functional wax. In a preferred embodiment, the acid-functional wax is used in conjunction with a basic-functional amphipathic copolymer or visual enhancement additive or the basic-functional wax is used in conjunction with an acid-functional amphipathic copolymer or visual enhancement additive.

A method of making a dry electrographic toner composition is also provided, comprising the steps of first providing a liquid carrier having a Kauri-Butanol number less than about 30 mL and polymerizing polymerizable compounds in the liquid carrier to form polymeric binder particles comprising at least one amphipathic copolymer comprising one or more S material portions and one or more D material portions. Toner particles are then formulated in the liquid carrier comprising the polymeric binder and at least one visual enhancement additive. A plurality of toner particles are then dried to provide a dry toner particle composition. These particles are then milled in the presence of a wax component so that the wax is associated with the toner particles.

Surprisingly, the toner particles as described herein provide dry toners that can exhibit excellent final image durability and erasure resistance properties, and provide a toner composition that provides excellent images at low fusion temperatures on a final image receptor. This combination of properties further advantageously can provide a greater range of appropriate fusion temperatures for toner compositions of the present invention. While not being bound by theory, it is believed that because the wax is not covalently bonded to the toner particle, the wax is sufficiently mobile to prevent undesirable partial transfer (offset) of the toned image from the final image receptor to the fuser surface during an imaging process. The wax, however, surprisingly does not migrate from the toner particle under conditions of use in a manner that would adversely affect triboelectric charging of the toner particle or that would contaminate the photoreceptor, intermediate transfer element, fuser element, or other surfaces critical to the electrophotographic process.

The use of wax in electrographic toner compositions beneficially further allows formulation of toner particles using a wider range of starting materials, such as alternative monomers to be incorporated in the polymeric binder, that otherwise would not be suitable for use in these compositions because the fusing temperature would otherwise be unacceptably high.

DETAILED DESCRIPTION OF PRESENTLY PREFERRED EMBODIMENTS

The embodiments of the present invention described below are not intended to be exhaustive or to limit the invention to the precise forms disclosed in the following detailed description. Rather, the embodiments are chosen and described so that others skilled in the art can appreciate and understand the principles and practices of the present invention.

The toner particles of the dry toner composition comprise a polymeric binder that comprises an amphipathic copolymer. The term "amphipathic" refers to a copolymer having a combination of portions having distinct solubility and dispersibility characteristics in a desired liquid carrier that is used to make the organosol and/or used in the course of preparing the dry toner particles. Preferably, the liquid carrier is selected such that at least one portion (also referred to herein as S material or portion(s)) of the copolymer is more solvated by the carrier while at least one other portion (also referred to herein as D material or portion(s)) of the copolymer constitutes more of a dispersed phase in the carrier.

Preferably, the nonaqueous liquid carrier of the organosol is selected such that at least one portion (also referred to herein as the S material or portion) of the amphipathic copolymer is more solvated by the carrier while at least one other portion (also referred to herein as the D material or portion) of the copolymer constitutes more of a dispersed phase in the carrier. In other words, preferred copolymers of the present invention comprise S and D material having respective solubilities in the desired liquid carrier that are sufficiently different from each other such that the S blocks tend to be more solvated by the carrier while the D blocks tend to be more dispersed in the carrier. More preferably, the S blocks are soluble in the liquid carrier while the D blocks are insoluble. In particularly preferred embodiments, the D material phase separates from the liquid carrier, forming dispersed particles.

From one perspective, the polymer particles when dispersed in the liquid carrier can be viewed as having a core/shell structure in which the D material tends to be in the core, while the S material tends to be in the shell. The S material thus functions as a dispersing aid, steric stabilizer or graft copolymer stabilizer, to help stabilize dispersions of the copolymer particles in the liquid carrier. Consequently, the S material can also be referred to herein as a "graft stabilizer." The core/shell structure of the binder particles tends to be retained when the particles are dried when incorporated into dry toner particles.

Wax to be incorporated in the toner composition is preferably provided in an amount effective to reduce the fusing temperature of the dry toner composition as compared to a like dry toner composition not comprising wax. Preferably, the wax component is present in an amount of from about 1% to about 20%, and more preferably about 4% to about 10% by weight based on the toner particle weight.

Wax to be incorporated in the dry toner composition may be selected from any appropriate waxes providing the desired performance characteristics of the ultimate toner composition. Examples of types of waxes that may be used include polypropylene wax, silicone wax, fatty acid ester wax, and metallocene wax. Optionally, the wax can comprise an acidic functionality or a basic functionality. Preferably, the wax has a melting temperature of from about 60° C. to about 150° C., and preferably has a molecular weight of from about 10,000 to 1,000,000, and more preferably from about 50,000 to about 500,000 Daltons. Optionally, the wax may be insoluble in the liquid carrier in which the toner particle is formed. In such an embodiment, the absolute difference in Hildebrand solubility parameters between the wax and the liquid carrier is preferably greater than about 2.8 $MPa^{1/2}$, more preferably greater than about 3.0 $MPa^{1/2}$, and more preferably greater than about 3.2 $MPa^{1/2}$.

The solubility of a material, or a portion of a material such as a copolymeric portion, can be qualitatively and quantitatively characterized in terms of its Hildebrand solubility parameter. The Hildebrand solubility parameter refers to a solubility parameter represented by the square root of the cohesive energy density of a material, having units of $(\text{pressure})^{1/2}$, and being equal to $(\Delta H/RT)^{1/2}/V^{1/2}$, where $\Delta H$ is the molar vaporization enthalpy of the material, R is the universal gas constant, T is the absolute temperature, and V is the molar volume of the solvent. Hildebrand solubility parameters are tabulated for solvents in Barton, A. F. M., *Handbook of Solubility and Other Cohesion Parameters*, 2d Ed. CRC Press, Boca Raton, Fla., (1991), for monomers and representative polymers in *Polymer Handbook*, 3rd Ed., J. Brandrup & E. H. Immergut, Eds. John Wiley, N.Y., pp 519-557 (1989), and for many commercially available polymers in Barton, A. F. M., *Handbook of Polymer-Liquid Interaction Parameters and Solubility Parameters*, CRC Press, Boca Raton, Fla., (1990).

The degree of solubility of a material, or portion thereof, in a liquid carrier can be predicted from the absolute difference in Hildebrand solubility parameters between the material, or portion thereof, and the liquid carrier. A material, or portion thereof, will be fully soluble or at least in a highly solvated state when the absolute difference in Hildebrand solubility parameter between the material, or portion thereof, and the liquid carrier is less than approximately 1.5 $MPa^{1/2}$. On the other hand, when the absolute difference between the Hildebrand solubility parameters exceeds approximately 3.0 $MPa^{1/2}$, the material, or portion thereof, will tend to phase separate from the liquid carrier, forming a dispersion. When the absolute difference in Hildebrand solubility parameters is between 1.5 $MPa^{1/2}$ and 3.0 $MPa^{1/2}$, the material, or portion thereof, is considered to be weakly solvatable or marginally insoluble in the liquid carrier.

Consequently, in preferred embodiments, the absolute difference between the respective Hildebrand solubility parameters of the S material portion(s) of the copolymer and the liquid carrier is less than 3.0 $MPa^{1/2}$. In a preferred embodiment of the present invention, the absolute difference between the respective Hildebrand solubility parameters of the S material portion(s) of the copolymer and the liquid carrier is from about 2 to about 3.0 $MPa^{1/2}$. In a particularly preferred embodiment of the present invention, the absolute difference between the respective Hildebrand solubility parameters of the S material portion(s) of the copolymer and the liquid carrier is from about 2.5 to about 3.0 $MPa^{1/2}$. Additionally, it is also preferred that the absolute difference between the respective Hildebrand solubility parameters of the D material portion(s) of the copolymer and the liquid carrier is greater than 2.3 $MPa^{1/2}$, preferably greater than about 2.5 $MPa^{1/2}$, more preferably greater than about 3.0 $MPa^{1/2}$, with the proviso that the difference between the respective Hildebrand solubility parameters of the S and D material portion(s) is at least about 0.4 $MPa^{1/2}$, more preferably at least about 1.0 $MPa^{1/2}$. Because the Hildebrand solubility of a material can vary with changes in temperature, such solubility parameters are preferably determined at a desired reference temperature such as at 25° C.

Those skilled in the art understand that the Hildebrand solubility parameter for a copolymer, or portion thereof, can be calculated using a volume fraction weighting of the individual Hildebrand solubility parameters for each monomer comprising the copolymer, or portion thereof, as described for binary copolymers in Barton A. F. M., *Handbook of Solubility Parameters and Other Cohesion Parameters*, CRC Press, Boca Raton, p 12 (1990). The magnitude of the Hildebrand solubility parameter for polymeric materials is also known to be weakly dependent upon the weight average molecular weight of the polymer, as noted in Barton, pp 446-448. Thus, there will be a preferred molecular weight range for a given polymer or portion thereof in order to achieve desired solvating or dispersing characteristics. Similarly, the Hildebrand solubility parameter for a mixture can be calculated using a volume fraction weighting of the individual Hildebrand solubility parameters for each component of the mixture.

In addition, we have defined our invention in terms of the calculated solubility parameters of the monomers and solvents obtained using the group contribution method developed by Small, P. A., J. Appl. Chem., 3, 71 (1953) using Small's group contribution values listed in Table 2.2 on page VII/525 in the Polymer Handbook, 3rd Ed., J. Brandrup & E. H. Immergut, Eds. John Wiley, New York, (1989). We have chosen this method for defining our invention to avoid ambiguities which could result from using solubility parameter values obtained with different experimental methods. In addition, Small's group contribution values will generate solubility parameters that are consistent with data derived from measurements of the enthalpy of vaporization, and therefore are completely consistent with the defining expression for the Hildebrand solubility parameter. Since it is not practical to measure the heat of vaporization for polymers, monomers are a reasonable substitution.

For purposes of illustration, Table I lists Hildebrand solubility parameters for some common solvents used in an electrographic toner and the Hildebrand solubility parameters and glass transition temperatures (based on their high molecular weight homopolymers) for some common monomers used in synthesizing organosols.

TABLE I

| Hildebrand Solubility Parameters Solvent Values at 25° C. | | |
|---|---|---|
| Solvent Name | Kauri-Butanol Number by ASTM Method D1133-54T (ml) | Hildebrand Solubility Parameter ($MPa^{1/2}$) |
| Norpar ™ 15 | 18 | 13.99 |
| Norpar ™ 13 | 22 | 14.24 |
| Norpar ™ 12 | 23 | 14.30 |
| Isopar ™ V | 25 | 14.42 |

TABLE I-continued

| | | |
|---|---|---|
| Isopar ™ G | 28 | 14.60 |
| Exxsol ™ D80 | 28 | 14.60 |

Source: Calculated from equation #31 of Polymer Handbook, 3rd Ed., J. Brandrup E. H. Immergut, Eds. John Wiley, NY, p. VII/522 (1989).

Monomer Values at 25° C.

| Monomer Name | Hildebrand Solubility Parameter ($MPa^{1/2}$) | Glass Transition Temperature (° C.)* |
|---|---|---|
| 3,3,5-Trimethyl Cyclohexyl Methacrylate | 16.73 | 125 |
| Isobornyl Methacrylate | 16.90 | 110 |
| Isobornyl Acrylate | 16.01 | 94 |
| n-Behenyl acrylate | 16.74 | <−55 (58 m.p.)** |
| n-Octadecyl Methacrylate | 16.77 | −100 (28 m.p.)** |
| n-Octadecyl Acrylate | 16.82 | −55 (42 m.p.)** |
| Lauryl Methacrylate | 16.84 | −65 |
| Lauryl Acrylate | 16.95 | −30 |
| 2-Ethylhexyl Methacrylate | 16.97 | −10 |
| 2-Ethylhexyl Acrylate | 17.03 | −55 |
| n-Hexyl Methacrylate | 17.13 | −5 |
| t-Butyl Methacrylate | 17.16 | 107 |
| n-Butyl Methacrylate | 17.22 | 20 |
| n-Hexyl Acrylate | 17.30 | −60 |
| n-Butyl Acrylate | 17.45 | −55 |
| Ethyl Methacrylate | 17.62 | 65 |
| Ethyl Acrylate | 18.04 | −24 |
| Methyl Methacrylate | 18.17 | 105 |
| Styrene | 18.05 | 100 |

Calculated using Small's Group Contribution Method, Small, P. A. Journal of Applied Chemistry 3 p. 71 (1953). Using Group Contributions from Polymer Handbook, 3rd Ed., J. Brandrup E. H. Immergut, Eds., John Wiley, NY, p. VII/525 (1989).
*Polymer Handbook, 3rd Ed., J. Brandrup E. H. Immergut, Eds., John Wiley, NY, pp. VII/209-277 (1989). The $T_g$ listed is for the homopolymer of the respective monomer.
**m.p. refers to melting point for selected Polymerizable Crystallizable Compounds.

The liquid carrier is a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water.

The substantially nonaqueous liquid carrier can be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred liquid carriers include branched paraffinic solvent blends such as Isopar™ G, Isopar™ H, Isopar™ K, Isopar™ L, Isopar™ M and Isopar™ V (available from Exxon Corporation, NJ), and most preferred carriers are the aliphatic hydrocarbon solvent blends such as Norpar™ 12, Norpar™ 13 and Norpar™ 15 (available from Exxon Corporation, NJ). Particularly preferred liquid carriers have a Hildebrand solubility parameter of from about 13 to about 15 $MPa^{1/2}$. Preferred liquid carriers are relatively low boiling solvents (i.e having a boiling point preferably below about 200° C., more preferably below about 150° C., and most preferably below about 100° C.), which is particularly advantageous for drying of the toner particles. Examples of preferred liquid carriers include n-pentane, hexane, heptane, cyclopentane, cyclohexane and mixtures thereof.

As used herein, the term "copolymer" encompasses both oligomeric and polymeric materials, and encompasses polymers incorporating two or more monomers. As used herein, the term "monomer" means a relatively low molecular weight material (i.e., generally having a molecular weight less than about 500 Daltons) having one or more polymerizable groups. "Oligomer" means a relatively intermediate sized molecule incorporating two or more monomers and generally having a molecular weight of from about 500 up to about 10,000 Daltons. "Polymer" means a relatively large material comprising a substructure formed two or more monomeric, oligomeric, and/or polymeric constituents and generally having a molecular weight greater than about 10,000 Daltons.

The weight average molecular weight of the amphipathic copolymer of the present invention can vary over a wide range, and can impact imaging performance. The polydispersity of the copolymer also can impact imaging and transfer performance of the resultant dry toner material. Because of the difficulty of measuring molecular weight for an amphipathic copolymer, the particle size of the dispersed copolymer (organosol) can instead be correlated to imaging and transfer performance of the resultant dry toner material. Generally, the volume mean particle diameter ($D_v$) of the toner particles, determined by laser diffraction particle size measurement, preferably should be in the range of about 0.1 to about 100.0 microns, more preferably in the range of about 1 to about 20 microns, most preferably in the range of about 5 to about 10 microns.

In addition, a correlation exists between the molecular weight of the solvatable or soluble S material portion of the graft copolymer, and the imaging and transfer performance of the resultant toner. Generally, the S material portion of the copolymer has a weight average molecular weight in the range of 1000 to about 1,000,000 Daltons, preferably 5000 to 400,000 Daltons, more preferably 50,000 to 300,000 Daltons. It is also generally desirable to maintain the polydispersity (the ratio of the weight-average molecular weight to the number average molecular weight) of the S material portion of the copolymer below 15, more preferably below 5, most preferably below 2.5. It is a distinct advantage of the present invention that copolymer particles with such lower polydispersity characteristics for the S material portion are easily made in accordance with the practices described herein, particularly those embodiments in which the copolymer is formed in the liquid carrier in situ.

The relative amounts of S and D material portions in a copolymer can impact the solvating and dispersability characteristics of these portions. For instance, if too little of the S material portion(s) are present, the copolymer can have too little stabilizing effect to sterically-stabilize the organosol with respect to aggregation as might be desired. If too little of the D material portion(s) are present, the small amount of D material can be too soluble in the liquid carrier such that there can be insufficient driving force to form a distinct particulate, dispersed phase in the liquid carrier. The presence of both a solvated and dispersed phase helps the ingredients of particles self assemble in situ with exceptional uniformity among separate particles. Balancing these concerns, the preferred weight ratio of D material to S material is in the range of 1/20 to 20/1, preferably 1/1 to 15/1, more preferably 2/1 to 10/1, and most preferably 4/1 to 8/1.

Glass transition temperature, $T_g$, refers to the temperature at which a (co)polymer, or portion thereof, changes from a hard, glassy material to a rubbery, or viscous, material, corresponding to a dramatic increase in free volume as the (co)polymer is heated. The $T_g$ can be calculated for a (co)polymer, or portion thereof, using known $T_g$ values for the high molecular weight homopolymers (see, e.g., Table I herein) and the Fox equation expressed below:

$$1/T_g = w_1/T_{g1} + w_2/T_{g2} + \ldots w_i/T_{gi}$$

wherein each $w_n$ is the weight fraction of monomer "n" and each $T_{gn}$ is the absolute glass transition temperature (in degrees Kelvin) of the high molecular weight homopolymer of monomer "n" as described in Wicks, A. W., F. N. Jones & S. P. Pappas, Organic Coatings 1, John Wiley, NY, pp 54-55 (1992).

In the practice of the present invention, values of $T_g$ for the D or S material portion of the copolymer or of the soluble polymer were determined either using the Fox equation above or experimentally, using e.g., differential scanning calorimetry. The glass transition temperatures ($T_g$'s) of the S and D material portions can vary over a wide range and can be independently selected to enhance manufacturability and/or performance of the resulting dry toner particles. The $T_g$'s of the S and D material portions will depend to a large degree upon the type of monomers constituting such portions. Consequently, to provide a copolymer material with higher $T_g$, one can select one or more higher $T_g$ monomers with the appropriate solubility characteristics for the type of copolymer portion (D or S) in which the monomer(s) will be used. Conversely, to provide a copolymer material with lower $T_g$, one can select one or more lower $T_g$ monomers with the appropriate solubility characteristics for the type of portion in which the monomer(s) will be used.

Polymeric binder materials suitable for use in dry toner particles typically have a high glass transition temperature ($T_g$) of at least about 50-65° C. in order to obtain good blocking resistance after fusing, yet typically require high fusing temperatures of about 200-250° C. in order to soften or melt the toner particles and thereby adequately fuse the toner to the final image receptor. High fusing temperatures are a disadvantage for dry toner because of the long warm-up time and higher energy consumption associated with high temperature fusing and because of the risk of fire associated with fusing toner to paper at temperatures approaching the autoignition temperature of paper (233° C.).

In addition, some dry toners using high $T_g$ polymeric binders are known to exhibit undesirable partial transfer (offset) of the toned image from the final image receptor to the fuser surface at temperatures above or below the optimal fusing temperature, requiring the use of low surface energy materials in the fuser surface or the application of fuser oils to prevent offset.

A wide variety of one or more different monomeric, oligomeric and/or polymeric materials can be independently incorporated into the S and D material portions, as desired. Representative examples of suitable materials include free radically polymerized material (also referred to as vinyl copolymers or (meth)acrylic copolymers in some embodiments), polyurethanes, polyester, epoxy, polyamide, polyimide, polysiloxane, fluoropolymer, polysulfone, combinations of these, and the like. Preferred S and D material portions are derived from free radically polymerizable material. In the practice of the present invention, "free radically polymerizable" refers to monomers, oligomers, and/or polymers having functionality directly or indirectly pendant from a monomer, oligomer, or polymer backbone (as the case can be) that participate in polymerization reactions via a free radical mechanism. Representative examples of such functionality includes (meth)acrylate groups, olefinic carbon-carbon double bonds, allyloxy groups, alpha-methyl styrene groups, (meth)acrylamide groups, cyanate ester groups, vinyl ether groups, combinations of these, and the like. The term "(meth)acryl", as used herein, encompasses acryl and/or methacryl.

Free radically polymerizable monomers, oligomers, and/or polymers are advantageously used to form the copolymer in that so many different types are commercially available and can be selected with a wide variety of desired characteristics that help provide one or more desired performance characteristics. Free radically polymerizable monomers, oligomers, and/or monomers suitable in the practice of the present invention can include one or more free radically polymerizable moieties.

Representative examples of monofunctional, free radically polymerizable monomers include styrene, alpha-methylstyrene, substituted styrene, vinyl esters, vinyl ethers, N-vinyl-2-pyrrolidone, (meth)acrylamide, vinyl naphthalene, alkylated vinyl naphthalenes, alkoxy vinyl naphthalenes, N-substituted (meth)acrylamide, octyl (meth)acrylate, nonylphenol ethoxylate(meth)acrylate, N-vinyl pyrrolidone, isononyl (meth)acrylate, isobornyl(meth)acrylate, 2-(2-ethoxyethoxy)ethyl(meth)acrylate, 2-ethylhexyl(meth)acrylate, beta-carboxyethyl(meth)acrylate, isobutyl(meth)acrylate, cycloaliphatic epoxide, alpha-epoxide, 2-hydroxyethyl (meth)acrylate, (meth)acrylonitrile, maleic anhydride, itaconic acid, isodecyl(meth)acrylate, lauryl (dodecyl) (meth)acrylate, stearyl(octadecyl)(meth)acrylate, behenyl (meth)acrylate, n-butyl(meth)acrylate, methyl(meth)acrylate, ethyl(meth)acrylate, hexyl(meth)acrylate, (meth) acrylic acid, N-vinylcaprolactam, stearyl(meth)acrylate, hydroxy functional caprolactone ester(meth)acrylate, isooctyl(meth)acrylate, hydroxyethyl(meth)acrylate, hydroxymethyl(meth)acrylate, hydroxypropyl(meth)acrylate, hydroxyisopropyl (meth)acrylate, hydroxybutyl(meth)acrylate, hydroxyisobutyl(meth)acrylate, tetrahydrofurfuryl (meth)acrylate, isobornyl(meth)acrylate, glycidyl(meth) acrylate vinyl acetate, combinations of these, and the like.

The monomeric components that are reacted to form the S material portions are, in one embodiment of the present invention, selected to provide the desired $T_g$ of the S material portion by selection of monomers having $T_g$ s within a given range, matched with solubility parameter characteristics. Advantageously, the fusion characteristics and durability property characteristics of the toner and the resulting image formed therefrom can be manipulated by selection of relative $T_g$ s of components of S material portions of the amphipathic copolymer. In this manner, performance characteristics of toner compositions can be readily tailored and/or optimized for use in desired imaging systems.

The S material portion is preferably made from (meth) acrylate based monomers and comprises the reaction products of soluble monomers selected from the group consisting of trimethyl cyclohexyl methacrylate; t-butyl methacrylate; n-butyl methacrylate; isobornyl(meth)acrylate; 1,6-Hexanediol di(meth)acrylate; 2-hydroxyethyl methacrylate; lauryl methacrylate; and combinations thereof.

Preferred copolymers of the present invention can be formulated with one or more radiation curable monomers or combinations thereof that help the free radically polymerizable compositions and/or resultant cured compositions to satisfy one or more desirable performance criteria.

An exemplary class of radiation curable monomers that tend to have relatively high $T_g$ characteristics suitable for incorporation into the high $T_g$ component generally comprise at least one radiation curable (meth)acrylate monomer and at least one nonaromatic, alicyclic and/or nonaromatic heterocyclic monomer. Isobornyl(meth)acrylate is a specific example of one such monomer. A cured, homopolymer film formed from isobornyl acrylate, for instance, has a $T_g$ of 110° C. The monomer itself has a molecular weight of 222 g/mole, exists as a clear liquid at room temperature, has a viscosity of 9 centipoise at 25° C., and has a surface tension of 31.7 dynes/cm at 25° C. Additionally, 1,6-Hexanediol di(meth)acrylate is another example of a monomer with high $T_g$ characteristics. Other examples of preferred high $T_g$ components include trimethyl cyclohexyl methacrylate; t-butyl methacrylate; n-butyl methacrylate. Combinations of high $T_g$ components for use in both the S material portion and the soluble polymer are specifically contemplated, together with anchor grafting groups such as provided by use of HEMA subsequently reacted with TMI.

Examples of graft amphipathic copolymers that may be used in the present binder particles are described in Qian et al, U.S. Ser. No. 10/612,243, filed on Jun. 30, 2003, entitled ORGANOSOL INCLUDING AMPHIPATHIC COPOLYMERIC BINDER AND USE OF THE ORGANOSOL TO MAKE DRY TONERS FOR ELECTROGRAPHIC APPLICATIONS and Qian et al., U.S. Ser. No. 10/612,535, filed on Jun. 30, 2003, entitled ORGANOSOL INCLUDING AMPHIPATHIC COPOLYMERIC BINDER HAVING CRYSTALLINE MATERIAL, AND USE OF THE ORGANOSOL TO MAKE DRY TONER FOR ELECTROGRAPHIC APPLICATIONS, which are hereby incorporated by reference.

Copolymers of the present invention can be prepared by free-radical polymerization methods known in the art, including but not limited to bulk, solution, and dispersion polymerization methods. The resultant copolymers can have a variety of structures including linear, branched, three dimensionally networked, graft-structured, combinations thereof, and the like. A preferred embodiment is a graft copolymer comprising one or more oligomeric and/or polymeric arms attached to an oligomeric or polymeric backbone. In graft copolymer embodiments, the S material portion or D material portion materials, as the case can be, can be incorporated into the arms and/or the backbone.

Any number of reactions known to those skilled in the art can be used to prepare a free radically polymerized copolymer having a graft structure. Common grafting methods include random grafting of polyfunctional free radicals; copolymerization of monomers with macromonomers; ring-opening polymerizations of cyclic ethers, esters, amides or acetals; epoxidations; reactions of hydroxyl or amino chain transfer agents with terminally-unsaturated end groups; esterification reactions (i.e., glycidyl methacrylate undergoes tertiary-amine catalyzed esterification with methacrylic acid); and condensation polymerization.

Representative methods of forming graft copolymers are described in U.S. Pat. Nos. 6,255,363; 6,136,490; and 5,384,226; and Japanese Published Patent Document No. 05-119529, incorporated herein by reference. Representative examples of grafting methods are also described in sections 3.7 and 3.8 of Dispersion Polymerization in Organic Media, K. E. J. Barrett, ed., (John Wiley; New York, 1975) pp. 79-106, also incorporated herein by reference.

In preferred embodiments, the copolymer is polymerized in situ in the desired liquid carrier, as this yields substantially monodisperse copolymeric particles suitable for use in toner compositions. The resulting organosol is then preferably mixed or milled with at least one visual enhancement additive and optionally one or more other desired ingredients to form a desired toner particle. During such combination, ingredients comprising the visual enhancement particles and the copolymer will tend to self-assemble into composite particles having solvated (S) portions and dispersed (D) portions. Specifically, it is believed that the D material of the copolymer will tend to physically and/or chemically interact with the surface of the visual enhancement additive, while the S material helps promote dispersion in the carrier.

Representative examples of grafting methods also can use an anchoring group. The function of the anchoring group is to provide a covalently bonded link between the core part of the copolymer (the D material) and the soluble shell component (the S material). Preferred amphipathic copolymers are prepared by first preparing an intermediate S material portion comprising reactive functionality by a polymerization process, and subsequently reacting the available reactive functionalities with a graft anchoring compound. The graft anchoring compound comprises a first functionality that can be reacted with the reactive functionality on the intermediate S material portion, and a second functionality that is a polymerizably reactive functionality that can take part in a polymerization reaction. After reaction of the intermediate S material portion with the graft anchoring compound, a polymerization reaction with selected monomers can be carried out in the presence of the S material portion to form a D material portion having one or more S material portions grafted thereto.

Suitable monomers containing anchoring groups include: adducts of alkenylazlactone comonomers with an unsaturated nucleophile containing hydroxy, amino, or mercaptan groups, such as 2-hydroxyethylmethacrylate, 3-hydroxypropylmethacrylate, 2-hydroxyethylacrylate, pentaerythritol triacrylate, 4-hydroxybutylvinylether, 9-octadecen-1-ol, cinnamyl alcohol, allyl mercaptan, methallylamine; and azlactones, such as 2-alkenyl-4,4-dialkylazlactone.

The preferred methodology described above accomplishes grafting via attaching an ethylenically-unsaturated isocyanate (e.g., dimethyl-m-isopropenyl benzylisocyanate, TMI, available from CYTEC Industries, West Paterson, N.J.; or isocyanatoethyl methacrylate, IEM) to hydroxyl groups in order to provide free radically reactive anchoring groups.

A preferred method of forming a graft copolymer of the present invention involves three reaction steps that are carried out in a suitable substantially nonaqueous liquid carrier in which resultant S material is soluble while D material is dispersed or insoluble.

In a first preferred step, a hydroxyl functional, free radically polymerized oligomer or polymer is formed from one or more monomers, wherein at least one of the monomers has pendant hydroxyl functionality. Preferably, the hydroxyl functional monomer constitutes about 1 to about 30, preferably about 2 to about 10 percent, most preferably 3 to about 5 percent by weight of the monomers used to form the oligomer or polymer of this first step. This first step is preferably carried out via solution polymerization in a substantially nonaqueous solvent in which the monomers and the resultant polymer are soluble. For instance, using the Hildebrand solubility data in Table 1, monomers such as octadecyl methacrylate, octadecyl acrylate, lauryl acrylate, and lauryl methacrylate are suitable for this first reaction step when using an oleophilic solvent such as heptane or the like.

In a second reaction step, all or a portion of the hydroxyl groups of the soluble polymer are catalytically reacted with an ethylenically unsaturated aliphatic isocyanate (e.g. meta-isopropenyldimethylbenzyl isocyanate commonly known as TMI or isocyanatoethyl methacrylate, commonly known as IEM) to form pendant free radically polymerizable functionality which is attached to the oligomer or polymer via a polyurethane linkage. This reaction can be carried out in the same solvent, and hence the same reaction vessel, as the first step. The resultant double-bond functionalized polymer generally remains soluble in the reaction solvent and constitutes the S material portion material of the resultant copolymer, which ultimately will constitute at least a portion of the solvatable portion of the resultant triboelectrically charged particles.

The resultant free radically reactive functionality provides grafting sites for attaching D material and optionally additional S material to the polymer. In a third step, these grafting site(s) are used to covalently graft such material to the polymer via reaction with one or more free radically reactive monomers, oligomers, and or polymers that are initially soluble in the solvent, but then become insoluble as the molecular weight of the graft copolymer. For instance, using the Hildebrand solubility parameters in Table 1, monomers such as e.g. methyl(meth)acrylate, ethyl(meth)acrylate, t-butyl methacrylate and styrene are suitable for this third reaction step when using an oleophilic solvent such as heptane or the like.

The product of the third reaction step is generally an organosol comprising the resultant copolymer dispersed in the reaction solvent, which constitutes a substantially nonaqueous liquid carrier for the organosol. At this stage, it is believed that the copolymer tends to exist in the liquid carrier as discrete, monodisperse particles having dispersed (e.g., substantially insoluble, phase separated) portion(s) and solvated (e.g., substantially soluble) portion(s). As such, the solvated portion(s) help to sterically-stabilize the dispersion of the particles in the liquid carrier. It can be appreciated that the copolymer is thus advantageously formed in the liquid carrier in situ.

Before further processing, the copolymer particles can remain in the reaction solvent. Alternatively, the particles can be transferred in any suitable way into fresh solvent that is the same or different so long as the copolymer has solvated and dispersed phases in the fresh solvent.

The resulting organosol is then converted into toner particles by mixing the organosol with at least one visual enhancement additive. Optionally, one or more other desired ingredients also can be mixed or milled into the organosol before and/or after combination with the visual enhancement particles. During such combination, it is believed that ingredients comprising the visual enhancement additive and the copolymer will tend to self-assemble into composite particles having a structure wherein the dispersed phase portions generally tend to associate with the visual enhancement additive particles (for example, by physically and/or chemically interacting with the surface of the particles), while the solvated phase portions help promote dispersion in the carrier.

The visual enhancement additive(s) generally may include any one or more fluid and/or particulate materials that provide a desired visual effect when toner particles incorporating such materials are printed onto a receptor. Examples include one or more colorants, fluorescent materials, pearlescent materials, iridescent materials, metallic materials, flip-flop pigments, silica, polymeric beads, reflective and non-reflective glass beads, mica, combinations of these, and the like. The amount of visual enhancement additive coated on binder particles may vary over a wide range. In representative embodiments, a suitable weight ratio of copolymer to visual enhancement additive is from 1/1 to 20/1, preferably from 2/1 to 10/1 and most preferably from 4/1 to 8/1.

Useful colorants are well known in the art and include materials listed in the Colour Index, as published by the Society of Dyers and Colourists (Bradford, England), including dyes, stains, and pigments. Preferred colorants are pigments which may be combined with ingredients comprising the binder polymer to form dry toner particles with structure as described herein, are at least nominally insoluble in and nonreactive with the carrier liquid, and are useful and effective in making visible the latent electrostatic image. It is understood that the visual enhancement additive(s) may also interact with each other physically and/or chemically, forming aggregations and/or agglomerates of visual enhancement additives that also interact with the binder polymer. Examples of suitable colorants include: phthalocyanine blue (C.I. Pigment Blue 15:1, 15:2, 15:3 and 15:4), monoarylide yellow (C.I. Pigment Yellow 1, 3, 65, 73 and 74), diarylide yellow (C.I. Pigment Yellow 12, 13, 14, 17 and 83), arylamide (Hansa) yellow (C.I. Pigment Yellow 10, 97, 105 and 111), isoindoline yellow (C.I. Pigment Yellow138), azo red (C.I. Pigment Red 3, 17, 22, 23, 38, 48:1, 48:2, 52:1, and 52:179), quinacridone magenta (C.I. Pigment Red 122, 202 and 209), laked rhodamine magenta (C.I. Pigment Red 81:1, 81:2, 81:3, and 81:4), and black pigments such as finely divided carbon (Cabot Monarch 120, Cabot Regal 300R, Cabot Regal 350R, Vulcan X72, and Aztech EK 8200), and the like.

The toner particles of the present invention may additionally comprise one or more additives as desired. Additional additives include, for example, UV stabilizers, mold inhibitors, bactericides, fungicides, antistatic agents, anticaking agents, gloss modifying agents, other polymer or oligomer material, antioxidants, and the like.

The additives may be incorporated in the binder particle in any appropriate manner, such as combining the binder particle with the desired additive and subjecting the resulting composition to one or more mixing processes. Examples of such mixing processes include homogenization, microfluidization, ball-milling, attritor milling, high energy bead (sand) milling, basket milling or other techniques known in the art to reduce particle size in a dispersion. The mixing process acts to break down aggregated additive particles, when present, into primary particles (preferably having a diameter of about 0.05 to about 100.0 microns, more preferably having a diameter of about 0.1 to about 30 microns, most preferably having a diameter of about 0.5 to about 10 microns) and may also partially shred the binder into fragments that can associate with the additive. According to this embodiment, the copolymer or fragments derived from the copolymer then associate with the additives. Optionally, one or more visual enhancement agents may be incorporated within the binder particle, as well as coated on the outside of the binder particle.

One or more charge control agents can be added before or after this mixing process, if desired. Charge control agents are often used in dry toner when the other ingredients, by themselves, do not provide the desired triboelectric charging or charge retention properties. The amount of the charge control agent, based on 100 parts by weight of the toner solids, is generally 0.01 to 10 parts by weight, preferably 0.1 to 5 parts by weight.

Examples of positive charge control agents for the toner include nigrosine; modified products based on metal salts of fatty acids; quaternary-ammonium-salts such as tributylbenzylammonium-1-hydroxy-4-naphthosulfonic acid or tetrabutylammonium tetrafluoroborate; alkyl pyridinium halides, including cetyl pyridinium chloride and others as disclosed in U.S. Pat. No. 4,298,672; sulfates and bisulfates, including distearyl dimethyl ammonium methyl sulfate as disclosed in U.S. Pat. No. 4,560,635; distearyl dimethyl ammonium bisulfate as disclosed in U.S. Pat. Nos. 4,937,157, 4,560,635; onium salts analogous to the quaternary-ammonium-salts such as phosphonium salts, and lake pigments of these; triphenylmethane dyes, and lake pigments of these; metal salts of higher fatty acids; diorgano tin oxides such as dibutyl tin oxide, dioctyl tin oxide, and dicyclohexyl tin oxide; and diorgano tin borates such as dibutyl tin borate, dioctyl tin borate, and dicyclohexyl tin borate.

Further, homopolymers of monomers having the following general formula (1) or copolymers with the foregoing polymerizable monomers such as styrene, acrylic acid esters, and methacrylic acid esters may be used as the positive charge control agent. In that case, those charge control agents have functions also as (all or a part of) binder resins.

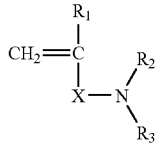

(1)

$R_1$ is H or $CH_3$;

X is a linking group, such as a—$(CH_2)_m$— group, where m is an integer between 1 and 20, inclusive, and one or more of the methylene groups is optionally replaced by —O—, —(O)C—, —O—C(O)—, —(O)C—O—. Preferably, X is selected from alkyl,

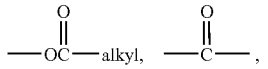

and alkyl-O-alkyl, where the alkyl group has from 1 to 4 carbons.

$R_2$ and $R_3$ are independently a substituted or unsubstituted alkyl group having (preferably 1 to 4 carbons).

Examples of commercially available positive charge control agents include azine compounds such as BONTRON N-01, N-04 and N-21; and quaternary ammonium salts such as BONTRON P-51 from Orient Chemical Company and P-12 from Esprix Technologies; and ammonium salts such as "Copy Charge PSY" from Clariant.

Examples of negative charge control agents for the toner include organometal complexes and chelate compounds. Representative complexes include monoazo metal complexes, acetylacetone metal complexes, and metal complexes of aromatic hydroxycarboxylic acids and aromatic dicarboxylic acids. Additional negative charge control agents include aromatic hydroxyl carboxylic acids, aromatic mono- and poly-carboxylic acids, and their metal salts, anhydrides, esters, and phenolic derivatives such as bisphenol. Other negative charge control agents include zinc compounds as disclosed in U.S. Pat. No. 4,656,112 and aluminum compounds as disclosed in U.S. Pat. No. 4,845,003.

Examples of commercially available negatively charged charge control agents include zinc 3,5-di-tert-butyl salicylate compounds, such as BONTRON E-84, available from Orient Chemical Company of Japan; zinc salicylate compounds available as N-24 and N-24HD from Esprix Technologies; aluminum 3,5-di-tert-butyl salicylate compounds, such as BONTRON E-88, available from Orient Chemical Company of Japan; aluminum salicylate compounds available as N-23 from Esprix Technologies; calcium salicylate compounds available as N-25 from Esprix Technologies; zirconium salicylate compounds available as N-28 from Esprix Technologies; boron salicylate compounds available as N-29 from Esprix Technologies; boron acetyl compounds available as N-31 from Esprix Technologies; calixarenes, such as such as BONTRON E-89, available from Orient Chemical Company of Japan; azo-metal complex Cr (III) such as BONTRON S-34, available from Orient Chemical Company of Japan; chrome azo complexes available as N-32A, N-32B and N-32C from Esprix Technologies; chromium compounds available as N-22 from Esprix Technologies and PRO-TONER CCA 7 from Avecia Limited; modified inorganic polymeric compounds such as Copy Charge N4P from Clariant; and iron azo complexes available as N-33 from Esprix Technologies.

Preferably, the charge control agent is colorless, so that the charge control agent does not interfere with the presentation of the desired color of the toner. In another embodiment, the charge control agent exhibits a color that can act as an adjunct to a separately provided colorant, such as a pigment. Alternatively, the charge control agent may be the sole colorant in the toner. In yet another alternative, a pigment may be treated in a manner to provide the pigment with a positive charge.

Examples of positive charge control agents having a color or positively charged pigments include Copy Blue PR, a triphenylmethane from Clariant. Examples of negative charge control agents having a color or negatively charged pigments include Copy Charge NY VP 2351, an Al-azo complex from Clariant; Hostacoply N4P-N101 VP 2624 and Hostacoply N4P-N203 VP 2655, which are modified inorganic polymeric compounds from Clariant.

The preferred amount of charge control agent for a given toner formulation will depend upon a number of factors, including the composition of the polymer binder. The preferred amount of charge control agent further depends on the composition of the S portion of the graft copolymer, the composition of the organosol, the molecular weight of the organosol, the particle size of the organosol, the core/shell ratio of the graft copolymer, the pigment used in making the toner, and the ratio of organosol to pigment. In addition, preferred amounts of charge control agent will also depend upon the nature of the electrophotographic imaging process, particularly the design of the developing hardware and photoreceptive element. It is understood, however, that the level of charge control agent may be adjusted based on a variety of parameters to achieve the desired results for a particular application.

Dry electrophotographic toner compositions of the present invention may be prepared by techniques as generally described above, including the steps of forming an amphipathic copolymer and formulating the resulting amphipathic copolymer into a dry electrophotographic toner composition. As noted above, the amphipathic copolymer is prepared in a liquid carrier to provide a copolymer having portions with the indicated solubility characteristics.

Addition of components of the ultimate toner composition, such as charge control agents or visual enhancement additives, can optionally be accomplished during the formation of the amphipathic copolymer. The step of formulating the resulting amphipathic copolymer into a dry electrophotographic toner composition comprises removing the carrier liquid from the composition to the desired level so that the composition behaves as a dry toner composition, and also optionally incorporating other desired additives such as charge control agents, visual enhancement additives, or other desired additives such as described herein to provide the desired toner composition.

The toner particles can be dried by any desired process, such as, for example, by filtration and subsequent drying of the filtrate by evaporation, optionally assisted with heating. Preferably, this process is carried out in a manner that minimizes agglomeration and/or aggregation of the toner particles into one or more large masses. If such masses form, they can optionally be pulverized or otherwise comminuted in order to obtain dry toner particles of an appropriate size.

Alternative drying configurations can be used, such as by coating the toner dispersed in the reaction solvent onto a drying substrate, such as a moving web. In a preferred embodiment, the coating apparatus includes a coating station at which the liquid toner is coated onto surface of a moving web wherein the charged toner particles are coated on the web by an electrically biased deposition roller. A preferred system for carrying out this coating process is described copending U.S. Utility patent application Ser. No. 10/881,637, filed Jun. 30, 2004, titled "DRYING PROCESS FOR TONER PARTICLES USEFUL IN ELECTROGRAPHY." An alternative preferred system comprises using extrusion techniques to help transfer toner particles, which may or may not be charged at this stage, from a reaction solvent onto a substrate surface. A relatively thin coating of extruded particles is formed on the surface as a consequence. Because the resultant coating has a relatively large drying surface area per gram of particle incorporated into the coating, drying can occur relatively quickly under moderate temperature and pressure conditions. A preferred system for carrying out this drying process is described in copending U.S. Utility patent application Ser. No. 10/880,799, filed Jun. 30, 2004, titled "EXTRUSION DRYING PROCESS FOR TONER PARTICLES USEFUL IN ELECTROGRAPHY."

The coated toner particles can optionally be squeezed to eliminate excess reaction solvent by passing the coated web between at least one pair of calendaring rollers. The calendaring rollers preferably can be provided with a slight bias that is higher than the deposition roller applied to keep the charged toner particles from transferring off the moving web. Downstream from the coating station components, the moving web preferably passes through a drying station, such as an oven, in order to remove the remaining reaction solvent to the desired degree. Although drying temperatures may vary, drying preferably occurs at a web temperature that is at least about 5° C. and more preferably at least about 10° C., below the effective $T_g$ of the toner particles. After emerging from oven, the dried toner particles on the moving web are preferably passed through a deionizer unit to help eliminate triboelectric charging, and are then gently removed from the moving web (such as by scraping with a plastic blade) and deposited into a collection device at a particle removal station.

The resulting toner particle may optionally be further processed by additional coating processes or surface treatment such as spheroidizing, flame treating, and flash lamp treating. If desired, the toner particle may be additionally milled by conventional techniques, such as using a planetary mill, to break apart any undesired particle aggregates.

The wax is milled with these dry toner particles using conventional milling equipment. Any appropriate milling technique may be used, such as ball-milling, attritor milling, high energy bead (sand) milling, basket milling or other techniques known in the art. In an aspect of the present invention, the wax is an acid-functional or basic-functional wax capable of chemically interacting (e.g. by non-covalent chemical bonding, such as hydrogen bonding or acid/base coupling) with acid-functional or basic-functional amphipathic copolymers or visual enhancement additives. Various methods for preparing toners comprising basic-functional amphipathic copolymers or visual enhancement additives for dry milling with acid-functional waxes; or for preparing toners comprising acid-functional amphipathic copolymers or visual enhancement additives for dry milling with basic-functional waxes are described in commonly assigned copending application Ser. No. 10/978,635 titled "LIQUID ELECTROPHOTOGRAPHIC TONERS COMPRISING AMPHIPATHIC COPOLYMERS HAVING ACIDIC OR BASIC FUNCTIONALITY AND WAX HAVING BASIC OR ACIDIC FUNCTIONALITY," filed on even date with the present application.

The toner particles may then be provided as a toner composition, ready for use, or blended with additional components to form a toner composition.

Toners of the present invention are in a preferred embodiment used to form images in electrophotographic processes. While the electrostatic charge of either the toner particles or photoreceptive element may be either positive or negative, electrophotography as employed in the present invention is preferably carried out by dissipating charge on a positively charged photoreceptive element. A positively-charged toner is then applied to the regions in which the positive charge was dissipated using a toner development technique.

The invention will further be described by reference to the following nonlimiting examples.

EXAMPLES

Glossary of Chemical Abbreviations

The following abbreviations are used in the examples that follow:

DBTDL: Dibutyl tin dilaurate (a catalyst available from Aldrich Chemical Co., Milwaukee, Wis.)

EMA: Ethyl methacrylate (available from Aldrich Chemical Co., Milwaukee, Wis.)

EXP-61: Amine-functional silicone wax (available from Genesee Polymer Corporation, Flint, Mich.)

GP-628: Amine-functional silicone wax (available from Genesee Polymer Corporation, Flint, Mich.)

HEMA: 2-Hydroxyethyl methacrylate (available from Aldrich Chemical Co., Milwaukee, Wis.)

Licocene PP 6102: Polypropylene Wax (available from Clariant Corporation, Coventry, R.I.)

Licowax F: Fatty Acid Ester Wax (available from Clariant Corporation, Coventry, R.I.)

TCHMA: 3,3,5-Trimethyl cyclohexyl methacrylate (available from Ciba Specialty Chemical Co., Suffolk, Va.)

TMI: Dimethyl-m-isopropenyl benzyl isocyanate (available from CYTEC Industries, West Paterson, N.J.)

Tonerwax S-80: Amide Wax (available from Clariant Corporation, Coventry, R.I.)

Unicid 350: Acid Ethene wax (available from Baker Hughes Co., Baker Petrolite Polymers Division, Sand Springs, Okla.)

Unicid 700: Acid Ethene wax (available from Baker Hughes Co., Baker Petrolite Polymers Division, Sand Springs, Okla.)

Unilin 350: Alcohol Ethoxylate (available from Baker Hughes Co., Baker Petrolite Polymers Division, Sand Springs, Okla.)

V-601: Dimethyl 2,2'-azobisisobutyrate (an initiator available as V-601 from WAKO Chemicals U.S.A., Richmond, Va.)

Technical Wax Information

| Wax Name | Available from | Chemical Structure | Melting Point ° C. | Norpar ™ 12 Solubility Limit (g/100 g) |
|---|---|---|---|---|
| Licocene PP6102 | Clariant Inc. Coventry, RI | Polypropylene | 100-145 | 3.49 |
| Tonerwax S-80 | Clariant Inc. Coventry, RI | Amide Wax | 60-90 | 0.44 |
| Silicone Wax GP-628 | Genesee Polymers, Flint, MI | Amine Functional Silicone | 56 | 7.03 |
| Unicid 350 | Baker Petrolite, Sugarland, TX | Acid Ethene Wax | 25-92 | 2.71 |
| Unicid 700 | Baker Petrolite, Sugarland, TX | Acid Ethene Wax | 80 | 0.04 |
| Unilin 350 | Baker Petrolite, Sugarland, TX | Alcohol Ethoxylate | 78-106 | Not available |
| EXP-61 | Genesee Polymers, Flint, MI | Amine Functional Silicone | 38 | 12.5 |

Test Methods and Procedures

Percent Solids Test

In the following toner composition examples, percent solids of the graft stabilizer solution, the organosol dispersion, the milled pigmented toner dispersion and the dry toners were determined thermo-gravimetrically by drying in an aluminum weighing pan an originally-weighed sample at 160° C. for two hours for graft stabilizer, three hours for organosol, and two hours for liquid toner dispersions, weighing the dried sample, and calculating the percentage ratio of the dried sample weight to the original sample weight, after accounting for the weight of the aluminum weighing pan. Approximately two grams of sample were used in each determination of percent solids using this thermo-gravimetric method.

Graft Stabilizer Molecular Weight

Various properties of the graft stabilizer have been determined to be important to the performance of the stabilizer, including molecular weight and molecular weight polydispersity. Graft stabilizer molecular weight is normally expressed in terms of the weight average molecular weight ($M_w$), while molecular weight polydispersity is given by the ratio of the weight average molecular weight to the number average molecular weight ($M_w/M_n$). Molecular weight parameters were determined for graft stabilizers with gel permeation chromatography (GPC) using tetrahydrofuran as the carrier solvent. Absolute $M_w$ was determined using a Dawn DSP-F light scattering detector (commercially obtained from Wyatt Technology Corp, Santa Barbara, Calif.), while polydispersity was evaluated by ratioing the measured $M_w$ to a value of $M_n$ determined with an Optilab DSC differential refractometer detector (commercially obtained from Wyatt Technology Corp, Santa Barbara, Calif.).

Particle Size

The organosol particle size distributions and the particle size of toner dispersions after pigment milling were determined using a Horiba LA-920 laser diffraction particle size analyzer (commercially obtained from Horiba Instruments, Inc, Irvine, Calif.) using Norpar™ 12 fluid that contains 0.1% Aerosol OT (dioctyl sodium sulfosuccinate, sodium salt, Fisher Scientific, Fairlawn, N.J.) surfactant. The dry toner particle size distributions were determined using a Horiba LA-900 laser diffraction particle size analyzer (commercially obtained from Horiba Instruments, Inc, Irvine, Calif.) using de-ionized water that contains 0.1% Triton X-100 surfactant (available from Union Carbide Chemicals and Plastics, Inc., Danbury, Conn.).

In both procedures, the samples were diluted by approximately 1/500 by volume and sonicated for one minute prior to measurement. Sonication on the Horiba LA-920 was operated at 150 watts and 20 kHz. The particle size was expressed on a number-average ($D_n$) basis in order to provide an indication of the fundamental (primary) particle size of the particles or was expressed on a volume-average ($D_v$) basis in order to provide an indication of the size of the coalesced, agglomerated primary particles.

Toner Charge (Blow-Off Q/M)

An important characteristic of xerographic toners is the toner's electrostatic charging performance (or specific charge), given in units of Coulombs per gram. The specific charge of each toner was established in the examples below using a blow-off tribo-tester instrument (Toshiba Model TB200 Blow-Off Powder Charge measuring apparatus with size #400 mesh stainless steel screens pre-washed in tetrahydrofuran and dried over nitrogen, Toshiba Chemical Co., Tokyo, Japan).

To measure the specific charge of each toner, a 0.5 g toner sample was first electrostatically charged by combining it with 9.5 g of MgCuZn Ferrite carrier beads (Steward Corp., Chattanooga, Tenn.) to form the developer in a plastic container. This developer was gently agitated using a U.S. Stoneware mill mixer for 5 min, 15 min, and 30 min intervals before 0.2 g of the toner/carrier developer was analyzed using a Toshiba Blow-off tester to obtain the specific charge (in microCoulombs/gram) of each toner. Specific charge measurements were repeated at least three times for each toner to obtain a mean value and a standard deviation. The data were evaluated for validity, namely, a visual observation that nearly all of the toner was blown-off of the carrier during the measurement. Tests were considered valid if nearly all of toner mass is blown-off from the carrier beads. Tests with low mass loss were rejected.

Conventional Differential Scanning Calorimetry

Thermal transition data for synthesized toner material was collected using a TA Instruments Model 2929 Differential Scanning Calorimeter (New Castle, Del.) equipped with a DSC refrigerated cooling system (−70° C. minimum temperature limit) and dry helium and nitrogen exchange gases. The calorimeter ran on a Thermal Analyst 2100 workstation with version 8.10B software. An empty aluminium pan was used as the reference. The samples were prepared by placing 6.0 to 12.0 mg of the experimental material into an aluminum sample pan and crimping the upper lid to produce a hermetically sealed sample for DSC testing. The results were normalized on a per mass basis. Each sample was evaluated using 10° C./min heating and cooling rates with a 5-10 min isothermal bath at the end of each heating or cooling ramp. The experimental materials were heated five times: the first heat ramp removes the previous thermal history of the sample and replaces it with the 10° C./min cooling treatment and subsequent heat ramps are used to obtain a stable glass transition temperature ($T_g$) value—values were reported from either the third or fourth heat ramp.

Graft stabilizer samples were prepared by precipitating and washing the sample in a non-solvent. The graft stabilizer samples were placed in an aluminum pan and dried in an oven at 100° C. for 1-2 hr. The organosol samples were placed in an aluminum pan and dried in an oven at 160° C. for 2-3 hr.

Fused Image Erasure Resistance:

In these experiments, the evaluation took place as soon as possible after fusing. This test was used to determine image durability when a printed image was subjected to abrasion from materials such as other paper, linen cloth, and pencil erasers.

In order to quantify the resistance of the dry toner to erasure forces after fusing, an erasure test has been defined. This erasure test consists of using a device called a Crockmeter to abrade the inked and fused areas with a linen cloth loaded against the ink with a known and controlled force. A standard test procedure followed generally by the inventors was defined in ASTM #F 1319-94 (American Standard Test Methods). The Crockmeter used in this testing was an AATCC Crockmeter Model CM1 manufactured by Atlas Electric Devices Company, Chicago, Ill. 60613.

A piece of linen cloth was affixed to the Crockmeter probe; the probe was placed onto the printed surface with a controlled force and caused to slew back and forth on the printed surface a prescribed number of times (in this case, 10 times by the turning of a small crank with 5 full turns at two slews per turn). The prepared samples were of sufficient length so that during the slewing, the linen-covered Crockmeter probe head never left the printed surface by crossing the ink boundary and slewing onto the paper surface.

For this Crockmeter, the head weight was 934 grams, which was the weight placed on the ink during the 10-slew test, and the area of contact of the linen-covered probe head with the ink was 1.76 $cm^2$. The results of this test were obtained as described in the standard test method, by determining the optical density of the printed area before the abrasion measured on paper and the optical density of any ink left on the linen cloth after the abrasion. The difference between the two numbers was divided by the original density and multiplied by 100% to obtain the percentage of erasure resistance.

Optical Density and Color Purity

To measure optical density and color purity a GRETAG SPM 50 LT meter was used. The meter was made by Gretag Limited, CH-8105 Regensdort, Switzerland. The meter has several different functions through different modes of operations, selected through different buttons and switches. When a function (optical density, for example) was selected, the measuring orifice of the meter was placed on a background, or non-imaged portion of the imaged substrate in order to "zero" it. It was then placed on the designated color patch and the measurement button was activated. The optical densities of the various color components of the color patch (in this case, Cyan (C), Magenta (M), Yellow (Y), and Black (K)) were displayed on the screen of the meter. The value of each specific component was then used as the optical density for that component of the color patch. For instance, where a color patch was only cyan, the optical density reading was listed as simply the value on the screen for C.

Fritsch Milling Procedure

Dry toner particles may be milled to a smaller size or to a more uniform range, or with additional additives (such as wax) using a planetary mono mill model LC-106A manufactured by Fritsch GMBH of Idar-Oberstien, Germany. Thirty-five grinding balls made of silicon-nitride ($Si_3N_4$) and having a 10 mm diameter were put into an 80 ml grinding bowl also made of $Si_3N_4$. Both the grinding balls and grinding bowl are manufactured by Fritsch GMBH. The toner (and any other optional additives) were weighed into the grinding bowl, then the grinding bowl was covered and securely mounted in the planetary mill. The planetary mill was run at 600 RPM for three milling cycles each lasting 3 minutes, 20 seconds. The mill was shut down for 5 minute periods between the first and second milling cycles and between the second and third milling cycles to minimize temperature increase within the grinding bowl. After the third milling cycle was completed, the grinding bowl was removed from the planetary mill and the grinding balls separated by pouring the contents onto a # 35 sieve. The milled toner powder was passed through the sieve onto a collection sheet and subsequently sealed in an airtight glass jar.

Dry Toner Fusing Procedure

A mask was placed on a sheet of white printing paper covering the entire page except an area 2 inches by 2 inches square. An amount of dry toner powder sufficient to completely cover the exposed area was placed in this square and was spread around gently with a bristle artist's brush. After about one minute of gentle brushing, the paper and the toner particles became tribocharged and the toner particles were attracted to the paper. This was continued until an even distribution of toner particles over the entire exposed area was achieved.

Next, the sheet of paper (including the mask) with the two-inch square patch of toner on it was placed on a six-inch audio loudspeaker in direct contact with the speaker cone and vibrated at 120 Hertz to achieve a very even distribution of toner in the square. Excess toner was removed by tilting the paper slightly so that gravity acted on the vibrating particles. Those particles not held in place electrostatically migrated away from the two-inch square dry toner patch where they were discarded. After the square was developed to a smooth and even toner image, the mask was removed and an optical density measurement was taken as described in the test method described herein. The paper, with the square toner image facing upward, was then passed twice between two heated, rubber fusing rollers at the speed of 1.5 inches per second. The top roller was heated to 240° C. and the bottom roller was heated to 180° C. The pneumatic force engaging the two rollers was 20 pounds per square inch. The optical density measurement was then repeated as described in the test method described herein.

Nomenclature

In the following examples, the compositional details of each copolymer will be summarized by ratioing the weight percentages of monomers used to create the copolymer. The grafting site composition is expressed as a weight percentage of the monomers comprising the copolymer or copolymer precursor, as the case may be. For example, a graft stabilizer (precursor to the S portion of the copolymer) designated TCHMA/HEMA-TMI (97/3-4.7% w/w) is made by copolymerizing, on a relative basis, 97 parts by weight TCHMA and 3 parts by weight HEMA, and this hydroxy functional polymer was reacted with 4.7 parts by weight of TMI.

Similarly, a graft copolymer organosol designated TCHMA/HEMA-TMI//EMA (97/3-4.7/100% w/w) is made by copolymerizing the designated graft stabilizer (TCHMA/HEMA-TMI (97/3-4.7% w/w)) (S portion or shell) with the designated core monomer EMA (D portion or core, 100% EMA) at a specified ratio of D/S (core/shell) determined by the relative weights reported in the examples.

Example 1

Graft Stabilizer Preparation

A 190 liter (50 gallon) reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with 88.48 kg (195 lbs) of Norpar™ 12, by vacuum. The vacuum was then broken and a flow of 1 CFH (cubic foot per hour) of nitrogen applied and the agitation is started at 70 RPM. 30.12 kg (66.4 lbs) of TCHMA was added and the container rinsed with 1.23 kg (2.7 lbs) of Norpar™ 12. 0.95 kg (2.10 lbs) of 98% (w/w) HEMA was added and the container rinsed with 0.62 kg (1.37 lbs) of Norpar™ 12. Finally 0.39 kg (0.86 lb) of V-601was added and the container rinsed with 0.09 kg (0.2 lbs) of Norpar™ 12. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 1 CFH was applied. Agitation was resumed at 75 RPM and the mixture was heated to 75° C. and held for 4 hours. The conversion was quantitative.

The mixture was heated to 100° C. and held at that temperature for 1 hour to destroy any residual V-601, and then was cooled back to 70° C. The nitrogen inlet tube was then removed, and 0.050 kg (0.11 lb) of 95% (w/w) DBTDL was added to the mixture using 0.62 kg (1.37 lbs) of Norpar™ 12 to rinse container, followed by 1.47 kg (3.23 lbs) of TMI. The TMI was added drop wise over the course of approximately 5 minutes while stirring the reaction mixture and the container was rinsed with 0.64 kg (1.4 lbs) of Norpar™ 12. The mixture was allowed to react at 70° C. for 2 hours, at which time the conversion was quantitative.

The mixture was then cooled to room temperature. The cooled mixture was a viscous, transparent liquid containing no visible insoluble matter. The percent solids of the liquid mixture were determined to be 26.2% (w/w) using the drying method described above. Subsequent determination of molecular weight was made using the GPC method described above; the copolymer had a $M_w$ of 270,800 and $M_w/M_n$ of 2.58 based on two independent measurements. The product is a copolymer of TCHMA and HEMA containing random side chains of TMI and is designated herein as TCHMA/HEMA-TMI (97/3-4.7% w/w) and can be used to make an organosol.

TABLE 1

| Graft Stabilizer | | | | |
|---|---|---|---|---|
| Example Number | Graft Stabilizer Compositions (% w/w) | Solids % (w/w) | Molecular Weight $M_w$ | $M_w/M_n$ |
| 1 | TCHMA/HEMA-TMI (97/3-4.7) | 26.2 | 270,800 | 2.58 |

Organosol Preparation

Example 2

This example illustrates the preparation of an amphipathic copolymer organosol at a D/S ratio of 8/1 using the graft stabilizer of Example 1. A 2128 liter (560 gallon) reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with a mixture of 689.5 kg (1520 lbs) of Norpar™ 12 and 43.9 kg (96.7 lbs) of the graft stabilizer mixture comparative example 1 @ 26.2% (w/w) polymer solids along with an additional 4.31 kg (9.5 lbs) of Norpar™ 12 to rinse the pump. Agitation was then turned on at a rate of 65 RPM, and temperature was check to ensure maintenance at ambient. Next 92.11 kg (203 lbs) of EMA was added along with 25.86 kg (57 lbs) Norpar™ 12 for rinsing the pump. Finally 1.03 kg (2.28 lbs) of V-601 was added, along with 4.31 kg (9.5 lbs) of Norpar™ 12 to rinse the container. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 0.5 CFH (cubic foot per hour) was applied. Agitation of 80 RPM was resumed and the temperature of the reactor was heated to 75° C. and maintained for 6 hours. The conversion was quantitative.

86.21 kg (190 lbs) of n-heptane and 172.41 kg (380 lbs) of Norpar™ 12 were added to the cooled organosol. The resulting mixture was stripped of residual monomer using a rotary evaporator equipped with a dry ice/acetone condenser. Agitation was held at 80 RPM and the batch heated to 95° C. The nitrogen flow was stopped and a vacuum of 126 torr was pulled and held for 10 minutes. The vacuum was then increased to 80, 50, and 31 torr, being held at each level for 10 minutes. The vacuum was increased to 20 torr and held for 30 minutes. At that point a full vacuum is pulled and 372 kg (820 lbs) of distillate was collected. Another 86.21 kg (190 lbs) of n-heptane and 172.41 kg (380 lbs) of Norpar™ 12 were added to the organosol. Agitation was held at 80 RPM and the batch heated to 95° C. The nitrogen flow was stopped and a vacuum of 126 torr was pulled and held for 10 minutes. The vacuum was then increased to 80, 50, and 31 torr, being held at each level for 10 minutes. Finally, the vacuum was increased to 20 torr and held for 30 minutes. At that point a full vacuum is pulled and an additional 603 lbs of distillate was collected. The vacuum was then broken, and the stripped organosol was cooled to room temperature, yielding an opaque white dispersion.

This organosol is designated TCHMA/HEMA-TMI//EMA (97/3-4.7//100% w/w). The percent solid of the organosol dispersion after stripping was determined as 13.2% (w/w) using the drying method described above. Subsequent determination of average particles size was made using the light scattering method described above; the organosol had a volume average diameter of 33.80 μm. The glass transition temperature was measured using DSC, as described above. The organosol particles had a $T_g$ of 68.12.

TABLE 2

| | Organosol |
|---|---|
| Example Number | Organosol Composition (% w/w) |
| 2 | TCHMA/EMA-TMI//EMA (97/3-4.7//100) |

Liquid Ink Preparation

Example 3

12,662 g of the above organosol from example 1 @ approximately 13.2% (w/w) solids in Norpar™ 12 was combined with 2,033 g of Norpar™ 12, 279 g of black pigment (Aztech EK8200, Magruder Color Company, Tucson, Ariz.) and 26.18 g of 26.6% (w/w) Zirconium HEX-CEM solution (OMG Chemical Company, Cleveland, Ohio). This mixture was then milled in a Hockmeyer HSD Immersion Mill (Model HMl, Hockmeyer Equipment Corp. Elizabeth City, N.C.) charged with 4,175 g of 0.8 mm diameter Yttrium Stabilized Ceramic Media (available from Morimura Bros. (USA) Inc., Torrance, Calif.). The mill was operated at 2,500 RPM for 60 minutes with water circulating through the jacket of the milling chamber at 80° C. The mill was then cooled to 45° C. and milled and additional 85 minutes. The milled toner concentrate was then put into 1 gallon polyethylene bottles.

A 13.0% (w/w) solids toner concentrate exhibited the following properties as determined using the test methods described above:

Volume Mean Particle Size: 6.69 μm

Q/M: 362 μC/g

Bulk Conductivity 462 picoMhos/cm

Percent Free Phase Conductivity: 2.60%

Dry Toner Preparation

Example 4

To produce a dry toner, the Norpar 12™ in the milled toner concentrate of Example 3 was removed using the toner drying procedure described above. The dryness of the toner was determined using the previously described drying method. The percent solids of the dry toner was found to be 96.6% (w/w).

Dry Blended Toner Preparations

To illustrate the invention the following examples were prepared using the Fritsch milling procedure in which 6.0% (w/w), 12.0% (w/w) and 18.0% (w/w) of 8 different waxes were blended into the toner powder of example 4.

Example 5

Comparative

For this example 7.50 grams of the dry toner of example 4 were weighed into an 80 ml Fritsch mill grinding bowl and blended as described in the Fritsch milling procedure.

Example 6

6.0% (w/w) of Unilin 350 wax was blended into the dry toner of example 4. For this example 7.05 grams of the toner of example 4 and 0.45 grams of Unilin 350 wax were weighed into an 80 ml Fritsch mill grinding bowl and blended as described in the Fritsch milling procedure.

Example 7

12.0% (w/w) of Unilin 350 wax was blended into the dry toner of example 4. For this example 6.60 grams of the toner of example 4 and 0.90 grams of Unilin 350 wax were weighed into an 80 ml Fritsch mill grinding bowl and blended as described in the Fritsch milling procedure.

Example 8

18.0% (w/w) of Unilin 350 wax was blended into the dry toner of example 4. For this example 6.15 grams of the toner of example 4 and 1.35 grams of Unilin 350 wax were weighed into an 80 ml Fritsch mill grinding bowl and blended as described in the Fritsch milling procedure.

Example 9

6.0% (w/w) of Unicid 350 wax was blended into the dry toner of example 4. For this example 7.05 grams of the toner of example 4 and 0.45 grams of Unicid 350 wax were weighed into an 80 ml Fritsch mill grinding bowl and blended as described in the Fritsch milling procedure.

Example 10

12.0% (w/w) of Unicid 350 wax was blended into the dry toner of example 4. For this example 6.60 grams of the toner of example 4 and 0.90 grams of Unicid 350 wax were weighed into an 80 ml Fritsch mill grinding bowl and blended as described in the Fritsch milling procedure.

Example 11

18.0% (w/w) of Unicid 350 wax was blended into the dry toner of example 4. For this example 6.15 grams of the toner of example 4 and 1.35 grams of Unicid 350 wax were weighed into an 80 ml Fritsch mill grinding bowl and blended as described in the Fritsch milling procedure.

Example 12

6.0% (w/w) of Unicid 700 wax was blended into the dry toner of example 4. For this example 7.05 grams of the toner of example 4 and 0.45 grams of Unicid 700 wax were weighed into an 80 ml Fritsch mill grinding bowl and blended as described in the Fritsch milling procedure.

Example 13

12.0% (w/w) of Unicid 700 wax was blended into the dry toner of example 4. For this example 6.60 grams of the toner of example 4 and 0.90 grams of Unicid 700 wax were weighed into an 80 ml Fritsch mill grinding bowl and blended as described in the Fritsch milling procedure.

Example 14

18.0% (w/w) of Unicid 700 wax was blended into the dry toner of example 4. For this example 6.15 grams of the toner of example 4 and 1.35 grams of Unicid 700 wax were weighed into an 80 ml Fritsch mill grinding bowl and blended as described in the Fritsch milling procedure.

Example 15

6.0% (w/w) of EXP-61 wax was blended into the dry toner of example 4. For this example 7.05 grams of the toner of example 4 and 0.45 grams of Gp-61 wax were weighed into an 80 ml Fritsch mill grinding bowl and blended as described in the Fritsch milling procedure.

Example 16

12.0% (w/w) of EXP-61 wax was blended into the dry toner of example 4. For this example 6.60 grams of the toner of example 4 and 0.90 grams of Gp-61 wax were weighed into an 80 ml Fritsch mill grinding bowl and blended as described in the Fritsch milling procedure.

Example 17

18.0% (w/w) of EXP-61 wax was blended into the dry toner of example 4. For this example 6.15 grams of the toner of example 4 and 1.35 grams of Gp-61 wax were weighed into an 80 ml Fritsch mill grinding bowl and blended as described in the Fritsch milling procedure.

Example 18

6.0% (w/w) of GP-628 wax was blended into the dry toner of example 4. For this example 7.05 grams of the toner of example 4 and 0.45 grams of Gp-628 wax were weighed into an 80 ml Fritsch mill grinding bowl and blended as described in the Fritsch milling procedure.

Example 19

12.0% (w/w) of GP-628 wax was blended into the dry toner of example 4. For this example 6.60 grams of the toner of example 4 and 0.90 grams of Gp-628 wax were weighed into an 80 ml Fritsch mill grinding bowl and blended as described in the Fritsch milling procedure.

Example 20

18.0% (w/w) of GP-628 wax was blended into the dry toner of example 4. For this example 6.15 grams of the toner of example 4 and 1.35 grams of Gp-628 wax were weighed into an 80 ml Fritsch mill grinding bowl and blended as described in the Fritsch milling procedure.

Example 21

6.0% (w/w) of Licocene PP 6102 wax was blended into the dry toner of example 4. For this example 7.05 grams of the toner of example 4 and 0.45 grams of Licocene PP 6102 wax were weighed into an 80 ml Fritsch mill grinding bowl and blended as described in the Fritsch milling procedure.

Example 22

12.0% (w/w) of Licocene PP 6102 wax was blended into the dry toner of example 4. For this example 6.60 grams of the toner of example 4 and 0.90 grams of Licocene PP 6102 wax were weighed into an 80 ml Fritsch mill grinding bowl and blended as described in the Fritsch milling procedure.

Example 23

18.0% (w/w) of Licocene PP 6102 wax was blended into the dry toner of example 4. For this example 6.15 grams of the toner of example 4 and 1.35 grams of Licocene PP 6102 wax were weighed into an 80 ml Fritsch mill grinding bowl and blended as described in the Fritsch milling procedure.

Example 24

6.0% (w/w) of Licowax F wax was blended into the dry toner of example 4. For this example 7.05 grams of the toner of example 4 and 0.45 grams of Licowax F wax were weighed into an 80 ml Fritsch mill grinding bowl and blended as described in the Fritsch milling procedure.

Example 25

12.0% (w/w) of Licowax F wax was blended into the dry toner of example 4. For this example 6.60 grams of the toner of example 4 and 0.90 grams of Licowax F wax were weighed into an 80 ml Fritsch mill grinding bowl and blended as described in the Fritsch milling procedure.

Example 26

18.0% (w/w) of Licowax F wax was blended into the dry toner of example 4. For this example 6.15 grams of the toner of example 4 and 1.35 grams of Licowax F wax were weighed into an 80 ml Fritsch mill grinding bowl and blended as described in the Fritsch milling procedure.

Example 27

6.0% (w/w) of Tonerwax S-80 wax was blended into the dry toner of example 4. For this example 7.05 grams of the toner of example 4 and 0.45 grams of Tonerwax S-80 wax were weighed into an 80 ml Fritsch mill grinding bowl and blended as described in the Fritsch milling procedure.

Example 28

12.0% (w/w) of Tonerwax S-80 wax was blended into the dry toner of example 4. For this example 6.60 grams of the toner of example 4 and 0.90 grams of Tonerwax S-80 wax were weighed into an 80 ml Fritsch mill grinding bowl and blended as described in the Fritsch milling procedure.

Example 29

18.0% (w/w) of Tonerwax S-80 wax was blended into the dry toner of example 4. For this example 6.15 grams of the toner of example 4 and 1.35 grams of Tonerwax S-80 wax were weighed into an 80 ml Fritsch mill grinding bowl and blended as described in the Fritsch milling procedure.

Illustrative examples 5 through 29 were evaluated for particle size, Q/M and image durability after fusing using the procedures described in the corresponding tests that are provided above.

TABLE 3

Dry Toner Charge, Particle Size and Fused Image Durability

| Example ID | Wax Additive | Wax Amount (% (w/w)) | Molecular Weight $D_v$ (μm) | Charge Per Mass (μC/g) 30 min | Image Durability (% abrasion resistance) |
|---|---|---|---|---|---|
| 5 Comp. | None | | 36.9 | 30.6 | 87.7 |
| 6 | Unilin 350 | 6% | 29.1 | 15.1 | 92.8 |
| 7 | Unilin 350 | 12% | 27.8 | 6.6 | 92.2 |
| 8 | Unilin 350 | 18% | 129.0 | 2.1 | 98.2 |
| 9 | Unicid 350 | 6% | 24.9 | 27.8 | 88.8 |
| 10 | Unicid 350 | 12% | 7.4 | 12.8 | 96.0 |
| 11 | Unicid 350 | 18% | 6.1 | 7.5 | 98.7 |
| 12 | Unicid 700 | 6% | 19.2 | 32.2 | 94.7 |
| 13 | Unicid 700 | 12% | 17.6 | 26.6 | 93.3 |
| 14 | Unicid 700 | 18% | 20.0 | 17.1 | 97.2 |
| 15 | EXP-61 | 6% | 27.2 | 47.8 | 82.0 |
| 16 | EXP-61 | 12% | 29.4 | 52.8 | 70.0 |
| 17 | EXP-61 | 18% | 9.1 | 57.1 | 80.1 |
| 18 | GP-628 | 6% | 33.2 | 52.2 | 76.7 |
| 19 | GP-628 | 12% | 14.2 | 55.5 | 88.5 |
| 20 | GP-628 | 18% | 33.2 | 45.6 | 88.5 |
| 21 | Licocene PP6102 | 6% | 20.5 | 28.9 | 81.7 |
| 22 | Licocene PP6102 | 12% | 12.5 | 28.0 | 93.1 |
| 23 | Licocene PP6102 | 18% | 25.4 | 16.0 | 92.9 |
| 24 | Licowax F | 6% | 21.2 | 29.6 | 86.3 |
| 25 | Licowax F | 12% | 23.9 | 24.4 | 94.7 |
| 26 | Licowax F | 18% | 99.4 | 12.4 | 97.5 |
| 27 | Tonerwax S-80 | 6% | 34.2 | 22.0 | 89.0 |
| 28 | Tonerwax S-80 | 12% | 64.6 | 15.7 | 94.4 |
| 29 | Tonerwax S-80 | 18% | 25.4 | 8.9 | 97.5 |

Other embodiments of this invention will be apparent to those skilled in the art upon consideration of this specification or from practice of the invention disclosed herein. All patents, patent documents, and publications cited herein are incorporated by reference as if individually incorporated. Various omissions, modifications, and changes to the principles and embodiments described herein can be made by one skilled in the art without departing from the true scope and spirit of the invention which is indicated by the following claims.

What is claimed is:

1. A dry electrographic toner composition comprising:

a plurality of dry toner particles, wherein the toner particles comprise polymeric binder comprising at least one amphipathic copolymer comprising one or more S material portions and one or more D material portions and at least one visual enhancement additive, said toner particles having a surface;

wherein the dry electrographic toner composition comprises a wax associated with the dry toner particles, wherein substantially all of the wax is associated with the toner particle at the surface thereof.

2. The dry electrographic toner composition of claim 1, wherein the wax component is present in an amount of from about 1% to about 20% by weight based on toner particle weight.

3. The dry electrographic toner composition of claim 1, wherein the wax component is present in an amount of from about 4% to about 10% by weight based on toner particle weight.

4. The dry electrographic toner composition of claim 1, wherein the wax has a melting temperature of from about 60° C. to about 150° C.

5. The dry electrographic toner composition of claim 1, wherein the wax is a polypropylene wax.

6. The dry electrographic toner composition of claim 1, wherein the wax is a silicone wax.

7. The dry electrographic toner composition of claim 1, wherein the wax is a fatty acid ester wax.

8. The dry electrographic toner composition of claim 1, wherein the wax is a metallocene wax.

9. The dry electrographic toner composition of claim 1, wherein the wax comprises an acidic functionality.

10. The dry electrographic toner composition of claim 1, wherein the amphipathic copolymer comprises a basic functionality.

11. The dry electrographic toner composition of claim 1, wherein the wax comprises a basic functionality.

12. The dry electrographic toner composition of claim 1, wherein the amphipathic copolymer comprises an acid functionality.

13. The dry electrographic toner composition of claim 1, wherein the wax has a molecular weight of from about 10,000 to 1,000,000.

14. The dry electrographic toner composition of claim 1, wherein the wax has a molecular weight of from about 50,000 to about 500,000 Daltons.

15. A method of making a dry electrographic toner composition comprising:

a) providing a liquid carrier having a Kauri-Butanol number less than about 30 mL;

b) polymerizing polymerizable compounds in the liquid carrier to form a polymeric binder comprising at least one amphipathic copolymer comprising one or more S material portions and one or more D material portions;

c) formulating toner particles in the liquid carrier comprising the polymeric binder of step b) and at least one visual enhancement additive;

d) drying a plurality of toner particles as formulated in step c) to provide a dry toner particle composition; and e) milling the dry toner particles of step d) in the presence of a wax component to provide a dry toner particle composition having the wax associated with the toner particles.

16. The product made by the process of claim 15.

* * * * *